US006665916B1

(12) United States Patent
Santorello et al.

(10) Patent No.: US 6,665,916 B1
(45) Date of Patent: Dec. 23, 2003

(54) ASH SILHOUETTE DISPLAY DEVICE

(76) Inventors: Maria Santorello, 6 Groton La., Coram, NY (US) 11727; Jena Consiglio, 6 Groton La., Coram, NY (US) 11727

( * ) Notice: Subject to any disclaimer, the term of this patent is extended or adjusted under 35 U.S.C. 154(b) by 0 days.

(21) Appl. No.: 10/161,822

(22) Filed: Jun. 4, 2002

(51) Int. Cl.[7] ..... A61G 17/00
(52) U.S. Cl. ..... 27/1
(58) Field of Search ..... 27/1; D99/5; 428/542.4; 40/124.5

(56) References Cited

U.S. PATENT DOCUMENTS 232,782 A * 9/1880 Townsend ..... 27/1
4,199,848 A 4/1980 Kohnert
5,016,330 A 5/1991 Botsch
5,230,127 A 7/1993 Zakowski
5,625,933 A 5/1997 Neuberger
5,740,637 A 4/1998 Snow
5,832,575 A * 11/1998 Sturino ..... 27/1
5,950,287 A * 9/1999 Cacciatore et al. ..... 27/1
5,950,288 A 9/1999 Bach Lahor
6,076,292 A * 6/2000 Kawa ..... 40/124.5
D436,758 S * 1/2001 Rodrigues ..... D6/470
6,170,136 B1 1/2001 Wilson-Brokl
D437,250 S * 2/2001 Hull et al. ..... D11/82
D445,557 S * 7/2001 Chang ..... D99/5
D449,418 S * 10/2001 Robinson ..... D99/5
6,347,439 B1 2/2002 Bach Lahor
D470,991 S * 2/2003 Goldstein ..... D99/5

* cited by examiner

*Primary Examiner*—William L. Miller

(57) ABSTRACT

A display of cremated remains of humans or animals in a decorative and artistic fashion. In the preferred mode, the remains are applied to one-dimensional or multi-dimensional objects, such as a wall hanging, plaque, or urn, in the form of a silhouette of the deceased. The silhouette may be of the face, head, or body of the person or pet, and, importantly, is derived from at least one photograph for image accuracy. In addition to the ash silhouette, the frame or plaque may include text relating to the deceased, such as the person or animal's name, dates of birth and death, or other inscription. Finally, the decorative item may also include other colors or graphics, including items or scenes related to the life of the deceased. Thus, in total, the method results in an artistic, aesthetically-pleasing reminder of a beloved family member or cherished pet.

10 Claims, 3 Drawing Sheets

ASH SILHOUETTE DISPLAY DEVICE

BACKGROUND OF THE INVENTION

1. Field of the Invention

The present invention is a means to display cremated remains of humans or animals in a decorative and artistic fashion. In the preferred mode, the remains are applied to one-dimensional or multi-dimensional objects, such as a wall hanging, plaque, or urn, in the form of a silhouette of the deceased.

The silhouette may be of the face, head, or body of the person or pet, and, importantly, is derived from at least one photograph for image accuracy. In addition to the ash silhouette, the frame or plaque may include text relating to the deceased, such as the person or animal's name, dates of birth and death, or other inscription. Finally, the decorative item may also include other colors or graphics, including items or scenes related to the life of the deceased. Thus, in total, the method results in an artistic, aesthetically-pleasing reminder of a beloved family member or cherished pet.

2. Description of the Prior Art

Numerous innovations for remains and display devices have been provided in the prior art that are described as follows. Even though these innovations may be suitable for the specific individual purposes to which they address, they differ from the present invention as hereinafter contrasted. The following is a summary of those prior art patents most relevant to the invention at hand, as well a description outlining the differences between the features of the present invention and those of the prior art.

1. U.S. Pat. No. 6,170,136, invented by Wilson-Brokl, entitled "Cremated Remains Display Upon A Substrate System And Method Therefor"

The patent to Wilson-Brokl describes a presentation system and method of preparation thereof for the display of cremated remains. Further, the system teaches a particular methodology for the artistic application of cremated remains upon a substrate for presentation. The present system contemplates a unique presentation of the cremated remains as a wall hanging in the form of a painting or the like, which includes thereupon the application of the cremated remains in an artistic and aesthetic fashion into the artwork itself. The preferred embodiment of the present system includes the steps of rendering an abstract or other artwork upon a generally flat substrate such as canvas, art board, Bristol board, or the like, then selectively applying an adhesive or like medium such as glue or the like upon the substrate and, prior to the adhesive medium's curing, applying at least a portion of the cremated remains upon the adhesive so that it adheres to the substrate, and is visible as a part of the artwork. The end result is a artwork which is pleasing to view, as well as providing a fitting remembrance to a loved one, in which the artwork can be selected to better memorialize the deceased.

2. U.S. Pat. No. 5,625,933, invented by Neuberger et al., entitled "Storage Container And Display For Cremated Remains"

The patent to Neuberger et al. describes a storage container for cremated remains which has a container having a plurality of walls for receiving the cremated remains through an opening in the container. A panel insert area is formed in the container for holding a decorative panel therein. The panel insert area has a bottom flange for holding the decorative panel along the bottom edge. A decorative panel having a decorative design thereon is supported in the panel insert area for displaying the decorative design. A removable top is attached over the container opening with a plurality of fasteners and has an elongated lip formed on one side thereof extending over one side of the front panel insert area and over one edge of the decorative panel in the insert area to thereby hold the decorative panel in the insert area along the top edge. A system for storing a plurality of storage containers for cremated remains includes a plurality of horizontal frame members having a plurality of urn support brackets attached thereto with each bracket having a generally cross cross-section shape for supporting each of the urns in a predetermined position. Each urn can have a portion of an image displayed thereon so that a plurality of urn display panels can be attached to the supports to form a complete image.

3. U.S. Pat. No. 5,230,127, invented by Zukowski et al., entitled "Personalized Face Cremation Urn"

In the patent to Zukowski et al., a cremation urn has a front wall with human readable indicia (such as the name of a deceased human or pet) formed integrally with the front wall, the front wall actually being a component of the urn. The indicia may be relief indicia, as formed by sand blasting decorative stone such as granite or marble, or raised indicia, such as formed with a bronze casting. Side walls with grooves for receiving the front wall side edges, and edges of a common top, rear, and partial bottom piece of malleable material (e.g. brass), are held together with a number of bolts and cooperating T-nuts, with the bolt holes covered with plugs, or by hooks and turnbuckles. The bottom includes a removable plate, which allows access to the interior volume so that ashes in a bag may be readily inserted into, and removed from, the container.

4. U.S. Pat. No. 5,950,288, invented by Bach Lahor, entitled "Urn For Housing Of Ashes"

The patent to Bach Lahor describes an urn for inhumation ashes which has a frame with a front area delimiting a large open space, an urn body adapted to store ashes and located in the open space, a graphic sheet located forwardly of the urn body, a transparent element located forwardly of the graphic sheet, and a rear protecting sheet arranged behind the urn body, the urn body, the graphic sheet, the transparent element and the rear protecting sheet being located inside the frame.

5. U.S. Pat. No. 6,347,439, invented by Bach Lahor, entitled "Self-Mountable Niche For Remains Ashes"

This patent to Bach Lahor describes a self-mountable niche for remain ashes which has a substantially closed box, a receptacle for accommodating ashes and insertable in the box, a supporting element connected with the box and supporting the latter, and a fastening and locking element connected with the supporting element for placing the niche at a corresponding location.

6. U.S. Pat. No. 5,740,637, invented by Snow, entitled "Cremation Niche"

In the patent to Snow, a cremation niche for holding the cremated remains of a deceased living being is disclosed. The cremation niche includes a precast concrete block preferably having a size and consistency of a conventional cast building block. A cavity within the concrete block with access thereinto through an opening in the front upright surface of the concrete block provides access into the cavity for placing the cremated remains therein. A front face block matches the dimensions of the front surface of the concrete block and is connectable thereto by fasteners. A seal between the face block and the front face of the concrete block seals the cavity and protects the cremated remains. A separate molded plastic liner fitted into the cavity further enhances a hermetic seal within the cavity. Spacer tabs formed into one horizontal surface and one end surface of the concrete block enhance ease of building a wall of the filled and sealed niches with precise spacing between niches.

7. U.S. Pat. No. 5,016,330, invented by Botsch, entitled "Personalized Pet Animal Memorial Product"

In the patent to Botsch, a method of memorializing a living being produces an inscribed image having a shaped surface. The method comprises cremating the expired remains of a living being to produce a resultant particulate ash product. A mixture of moldable materials is prepared and adapted for forming a molded object. At least a portion of the resultant particulate ash product is blended with the mixture of particulate moldable materials to produce a moldable product. The moldable product is then formed as an image having a shaped surface. The shaped image is processed to produce a rigid object consisting of permanently bonded particulate ash product and moldable materials. The shaped surface is then inscribed with indicia descriptive of the identity of the living being from which the resultant ash product has been obtained. In a specific embodiment, the living being is an animal such as a dog, a cat, a bird and the like.

8. U.S. Pat. No. 4,199,848, invented by Kohnert, entitled "Burial Urn"

The patent to Kohnert describes a burial urn for storing the cremated remains of a deceased person and for displaying a memorial. The urn is constructed in the general shape of a book preferably from cast metal parts. A cast main body has an interior chamber with a single inlet opening closed by a removable closure plate for storing the remains. A cast frame is removably attached to the main body to provide a framed area on the front cover of the book shape for retaining and displaying a memorial. The urn may be slidably mounted on pairs of pivot pins to channel-like guide tracks on a support frame or the like. This mounting arrangement permits the urn to be pulled out of the support frame and pivoted for viewing the memorial, but prevents removal of the urn from the support frame without a special tool.

Generally, the prior patents illustrate various means to display cremated remains, including: urns with personalized text upon the exterior thereof; personalized containers in the form of slidable drawers; various storage containers intended to be placed within large collections of remains of multiple persons and animals; addition of ashes to previously-existing paintings or graphic works of art; and a particular method for producing pet memorial items, utilizing cremated ash, permanent bond material, and moldable shapes.

Unlike the above, the present invention is a decorative item featuring a silhouette of the face, head, or body of the person or pet. The silhouette is derived from a photograph of the deceased for image accuracy, and the item may include the person or animal's name, dates of birth and death, and additional inscription. The decorative article may also include other colors or graphics, including items or scenes related to the life of the deceased.

SUMMARY OF THE INVENTION

As noted, the present invention is a means to display cremated remains of humans or animals in a decorative and artistic fashion. In the preferred mode, the remains are applied to one-dimensional or multi-dimensional objects, such as a wall hanging, plaque, or urn, in the form of a silhouette of the deceased.

The silhouette may be of the face, head, or body of the person or pet, and, importantly, is derived from at least one photograph for image accuracy. In addition to the ash silhouette, the frame or plaque may include text relating to the deceased, such as the person or animal's name, dates of birth and death, or other inscription. Finally, the decorative item may also include other colors or graphics, including items or scenes related to the life of the deceased. Thus, in total, the method results in an artistic, aesthetically-pleasing reminder of a beloved family member or cherished pet.

In light of the foregoing, it is generally an object of the present invention to provide a memorial item that uniquely displays a highly accurate silhouette of at least the head of a beloved person or pet.

It is also an object of the invention to provide a device that may be highly personalized, such as by including text relating to the life of the person or animal being memorialized.

It is a further object of the invention to provide a decorative item that may be constructed of a variety of materials.

It is an additional object of the invention to provide a decorative item that may be produced in a variety of sizes.

Finally, it is an object of the present invention to provide an item that is durable and that maintains its desired appearance for extended periods of time.

The novel features which are considered characteristic for the invention are set forth in the claims. The invention itself, both as to its construction and its method of operation, together with additional objects and advantages thereof, will be best understood from the following description of the embodiments when read and understood in connection with accompanying drawings.

BRIEF DESCRIPTION OF PREFERRED EMBODIMENTS

DETAILED DESCRIPTION OF THE PREFERRED EMBODIMENT

Figure 1:
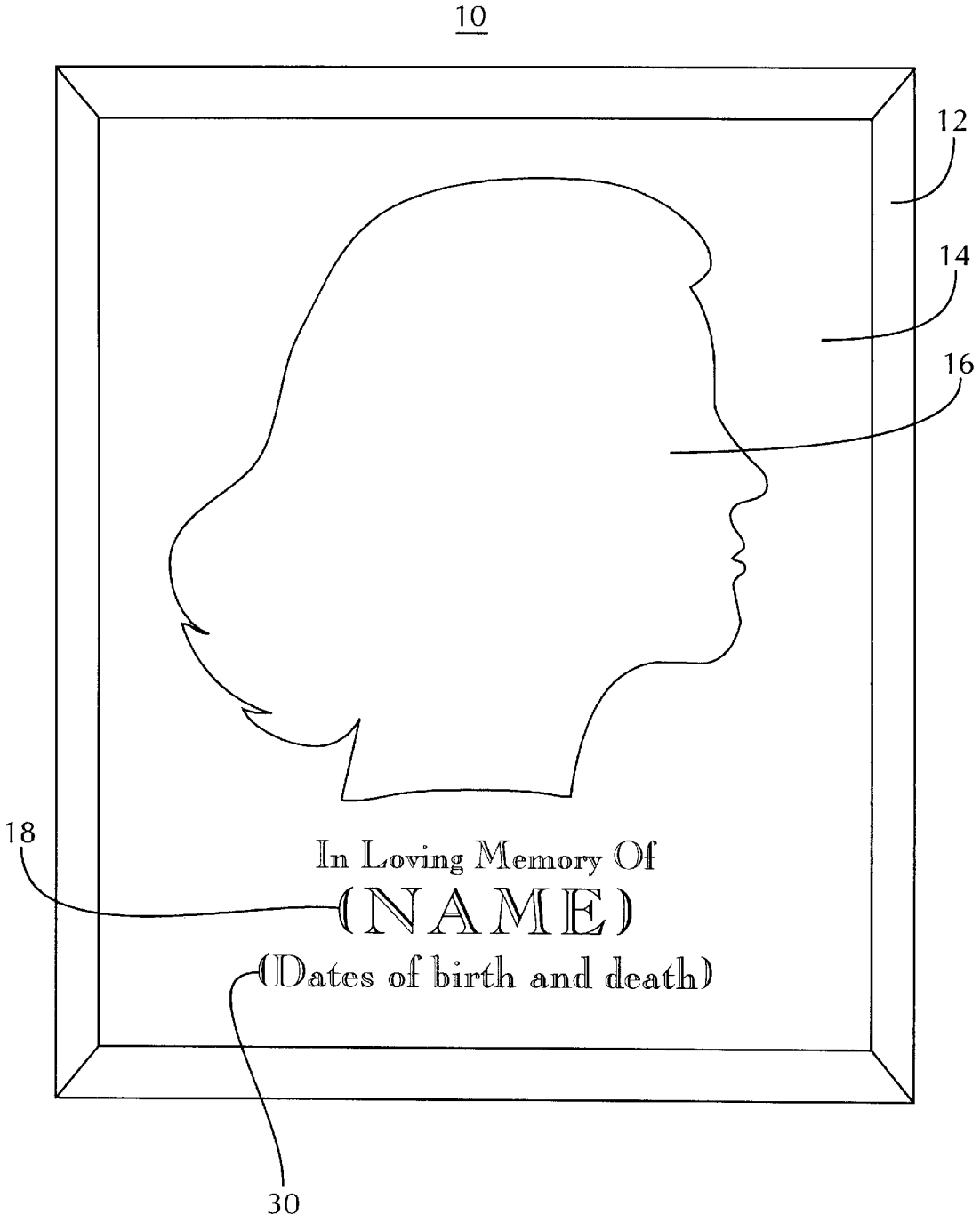
FIG. 1 is a front perspective view of the present invention, shown in a standard rectangular shape and including examples of text relating to the subject in question.
Figure 2:
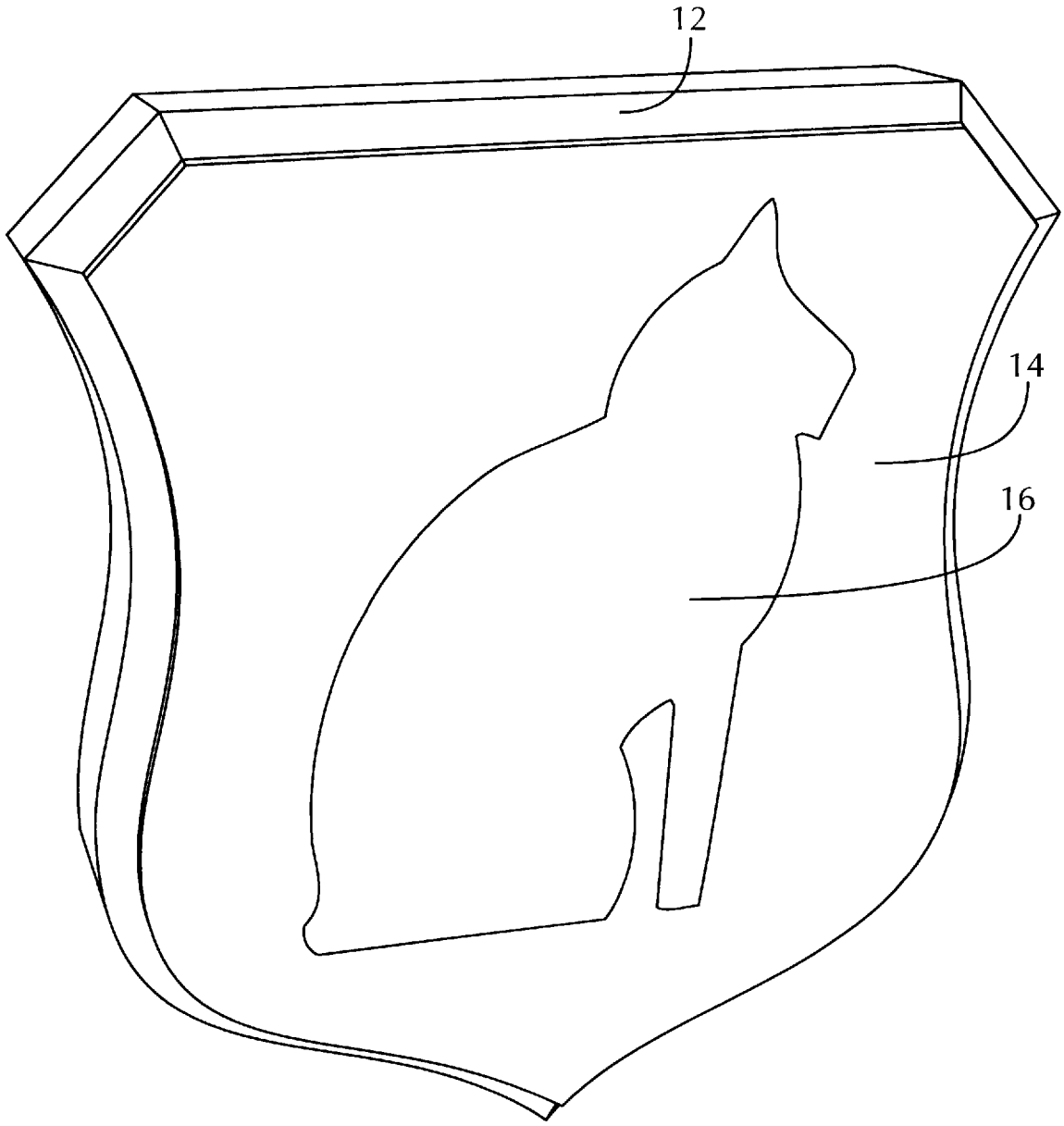
FIG. 2 is a front three quarter perspective view of an alternate shape of the present invention, including a silhouette of a pet, shown for the purposes of example only.
Figure 3:
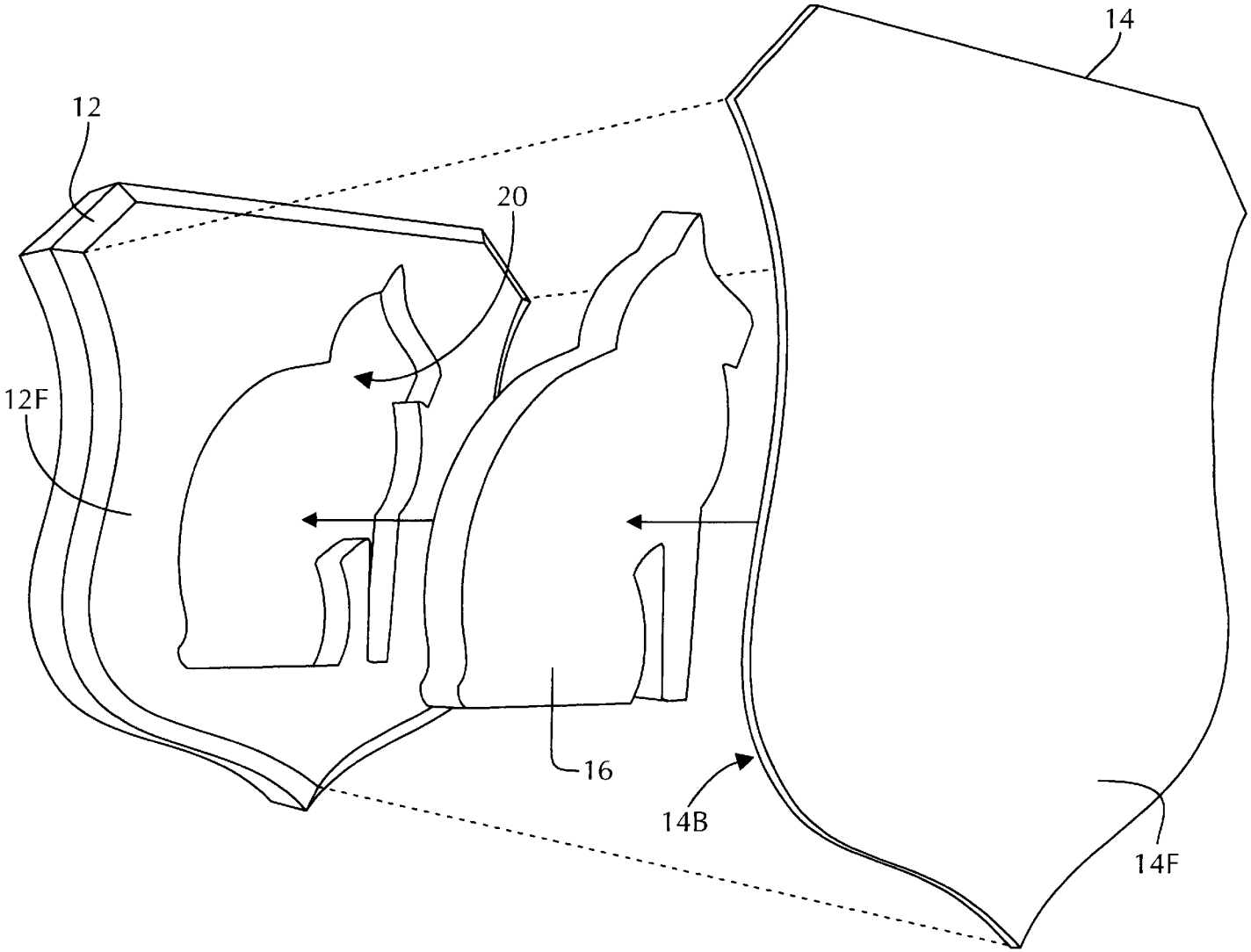
FIG. 3 is an exploded view of the item of FIG. 2, illustrating the separate components that make up the present invention.

Referring to FIG. 1, which is a front perspective view of the present invention, shown in a standard rectangular shape and including examples of text relating to the subject in question; FIG. 2, which is a front three quarter perspective view of an alternate shape of the present invention, including a silhouette of a pet, shown for the purposes of example only; and FIG. 3, which is an exploded view of the item of FIG. 2, illustrating the separate components that make up the present invention:

an ash silhouette display device comprises a frame (12) of a previously-determined size and shape. The frame (12) is much like a picture frame in the preferred mode, and comprises a frame front side (12F) and frame back side. The frame may be of a shape selected from the group consisting of square, rectangular, round, oval, atypical. In enhanced modes, the frame or base component may be multi-dimensional, such as an urn or container.

Following the example of a generally flat, two-dimensional frame, the frame front side (12F) comprises a indentation (20) thereon. The indentation is of a previously-determined size, and of a shape corresponding directly to a silhouette of at least a head of a cremated person or animal being memorialized.

A previously-determined quantity of actual ash remains of the cremated person or animal being memorialized (16) are placed within the indentation. A generally translucent outer panel (14) covers the frame front side (12F) The translucent outer panel (14) comprises an outer panel front side (14F) and outer panel back side (14B).

A first section of indicia (18) is located upon the outer panel front side (14F) and a second section of indicia (30) located upon the outer panel front side (14F), preferably below the first section. The first and second sections of indicia relate directly to the person or animal being memorialized.

The first section of indicia is in the form of previously determined text, graphics, designs, and colors. For example, in common modes of production, the text is the name of the person or animal being memorialized. Moreover, the text may include the dates of birth and death of the person or animal being memorialized, much in the manner of a headstone or other memorial display item. The text may also be a saying relating to the person or animal being memorialized, for the purpose of further personalizing the present invention. Much like the first section of indicia, the second section of indicia is in the form of previously determined text, graphics, designs, and colors, for the purpose of versatility in creating the device.

Importantly, the indentation may be created by utilizing an actual photograph of the person or animal being memorialized. Thus, the silhouette image will be highly accurate, such that those remembering the person or animal being memorialized will recognize the figure. This provides a unique memorial item that is far more personalized than those of the prior art.

Regarding options for the silhouette itself, the indentation may be of the shape of a silhouette of the head of the person or animal being memorialized. In addition, the indentation may be of the shape of a silhouette of the head, neck, and shoulder area of the person or animal being memorialized. Furthermore, particularly in the instance of a pet such as a cat or dog, the indentation may be of the shape of a silhouette of the entire body.

Finally, to enhance the overall decorative value of the device, and to further personalize the present invention to the person or animal being memorialized, the device further includes indicia in the form of graphics selected from the group consisting of flowers, outdoor scenes, and items relating to hobbies and interests of the person or animal being memorialized.

With regards to all descriptions and graphics, while the invention has been illustrated and described as embodied, it is not intended to be limited to the details shown, since it will be understood that various omissions, modifications, substitutions and changes in the forms and details of the device illustrated and in its operation can be made by those skilled in the art without departing in any way from the spirit of the invention.

Without further analysis, the foregoing will so fully reveal the gist of the present invention that others can readily adapt it for various applications without omitting features that, from the standpoint of prior art, constitute essential characteristics of the generic or specific aspects of this invention. What is claimed as new and desired to be protected by Letters Patent is set forth in the appended claims.

What is claimed is:

1. An ash silhouette display device comprising:

a frame (12) of a previously-determined size and shape, the frame (12) comprising a frame front side (12F) and frame back side;

the frame front side (12F) comprising an indentation thereon, the indentation (20) of a previously-determined size, and of a shape corresponding directly to a silhouette of at least a head of a cremated person or animal being memorialized;

a previously-determined quantity of actual ash remains of the cremated person or animal being memorialized (16) placed directly within the indentation;

a generally translucent outer panel (14) covering the frame front side (12F), the translucent outer panel (14) comprising an outer panel front side (14F) and outer panel back side (14B);

a first section of indicia (18) located upon the outer panel front side (14F); and a second section of indicia (30) located upon the outer panel front side (14F), the first and second sections of indicia relating directly to the person or animal being memorialized.

2. The ash silhouette display device as described in claim 1, wherein the frame is of a shape selected from the group consisting of square, rectangular, round, oval, atypical.

3. The ash silhouette display device as described in claim 1, wherein the first section of indicia is in the form of previously determined text, graphics, designs, and colors.

4. The ash silhouette display device as described in claim 3, wherein the text is the name of the person or animal being memorialized.

5. The ash silhouette display device as described in claim 3, wherein the text is the dates of birth and death of the person or animal being memorialized.

6. The ash silhouette display device as described in claim 3, wherein the text is a saying relating to the person or animal being memorialized.

7. The ash silhouette display device as described in claim 1, wherein the second section of indicia is in the form of previously determined text, graphics, designs, and colors.

8. The ash silhouette display device as described in claim 1, wherein the indentation is created by utilizing a photograph of the person or animal being memorialized.

9. The ash silhouette display device as described in claim 1, wherein the indentation is the shape of a silhouette of the head, neck, and shoulder area of the person or animal being memorialized.

10. The ash silhouette display device as described in claim 1, wherein the indentation is the shape of a silhouette of the entire body of the person or animal being memorialized.

* * * * *